US006701850B2

(12) United States Patent
McCabe et al.

(10) Patent No.: US 6,701,850 B2
(45) Date of Patent: Mar. 9, 2004

(54) FRICTION WEDGE LINER WITH BACKING PLATE

(75) Inventors: Thomas W. McCabe, Southern Pines, NC (US); Joseph F. Formolo, Laurinburg, NC (US); Bruce W. Shute, West End, NC (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/214,749

(22) Filed: Aug. 7, 2002

(65) Prior Publication Data

US 2004/0025740 A1 Feb. 12, 2004

(51) Int. Cl.[7] ..... B61F 5/00
(52) U.S. Cl. ..... 105/198.5
(58) Field of Search ..... 105/198.2, 198.3, 105/198.4, 198.5

(56) References Cited

U.S. PATENT DOCUMENTS 4,426,934 A * 1/1984 Geyer ..... 105/198.4
4,953,471 A * 9/1990 Wronkiewicz et al. .. 105/198.4
6,374,749 B1 * 4/2002 Duncan et al. ..... 105/198.5

* cited by examiner

*Primary Examiner*—Mark T. Le
(74) *Attorney, Agent, or Firm*—Webb Ziesenheim Logsdon Orkin & Hanson, P.C.

(57) ABSTRACT

A friction wedge assembly for use in a suspension system of railroad car trucks. The friction wedge assembly comprises a cast metal wedge having a bottom face, a vertical face that is substantially perpendicular to the bottom face and a sloped face for contacting a mating surface on a bolster of such railroad car truck. There is a metal backing plate that has a first side removably engageable with the vertical face of the cast metal wedge, a means for securing the metal backing plate to the cast metal wedge and a composition liner disposed on a second side of the metal backing plate for engaging such metal wear liner on such side frame of such railroad car truck.

19 Claims, 2 Drawing Sheets

FRICTION WEDGE LINER WITH BACKING PLATE

FIELD OF THE INVENTION

The present invention relates, in general, to a wedge shaped friction casting that serves as a shock absorber in the suspension of railroad cars and, more particularly, the present invention relates to a composition liner bonded to a backing plate for such wedge shaped friction casting.

BACKGROUND OF THE INVENTION

The suspension of railroad trucks include a wedge shaped friction casting which serves as a shock absorber. The wedge is supported by a spring and works between the bolster and the side frame. The sloped face of the wedge maintains contact with a mating face of the bolster while the vertical face of the wedge slides against a metal wear liner on the side frame. The spring pushes on the bottom face of the wedge thereby providing the load to force the wedge between the bolster and the side frame. The friction between the wedge and the side frame wear plate provides damping for the truck suspension.

Certain truck designs use a wedge with a composition friction liner bonded to the vertical face of the wedge. This composition liner provides the desired friction characteristics, particularly static friction similar to dynamic friction. The difficulty encountered with this design has been in obtaining a satisfactory bond of the composition liner to the cast metal wedge. Various methods of gluing a molded sheet of composition material and of bonding the material to the casting have been used. Under the severe operating and environmental conditions of railroad service, the composition liner sometimes separates from the cast metal wedge.

SUMMARY OF THE INVENTION

The present invention, therefore, provides a friction wedge assembly for use in a suspension system of railroad car trucks. The friction wedge assembly comprises a cast metal wedge having a bottom face, a vertical face that is substantially perpendicular to the bottom face and a sloped face for contacting a mating surface on a bolster of such railroad car truck.

There is a metal backing plate that has a first side removably engageable with the vertical face of the cast metal wedge and a means for securing the metal backing plate to the cast metal wedge. There is further a composition liner disposed on a second side of the metal backing plate for engaging such metal wear liner on such side frame of such railroad car truck.

OBJECTS OF THE INVENTION

It is, therefore, one of the primary objects of the present invention to provide a composition liner with a backing plate for a friction wedge assembly to eliminate the need for bonding the composition material to the cast metal wedge.

Another object of the present invention is to provide a composition liner with a backing plate for a friction wedge assembly that can be replaced easily thereby renewing the wear surface without having to install a new wedge casting.

Still another object of the present invention is to provide a composition liner with a backing plate for a friction wedge assembly that will reduce the need for handling the heavy wedge casting.

Yet another object of the present invention is to provide a composition liner with a backing plate for a friction wedge assembly that will be easily made interchangeable with existing wedge castings.

Another object of the present invention is to provide a composition liner with a backing plate for a friction wedge assembly in which the bonding of the composition friction surface is improved.

It is yet another object of the present invention to provide a composition liner with a backing plate for a friction wedge assembly that can be installed without the need for special tools.

Still another object of the present invention is to provide a composition liner with a backing plate for a friction wedge assembly wherein the composition liner can be assembled to the wedge casting at any location.

Another object of the present invention is to provide a composition liner with a backing plate for a friction wedge assembly in which the friction wedge casting is cost effective.

Yet another object of the present invention is to provide a composition liner with a backing plate for a friction wedge assembly which will reduce maintenance.

These and various other objects and advantages of this invention will become apparent after a full reading of the following detailed description, particularly, when read in conjunction with the attached drawings as described below and the appended claims.

Figure 1:
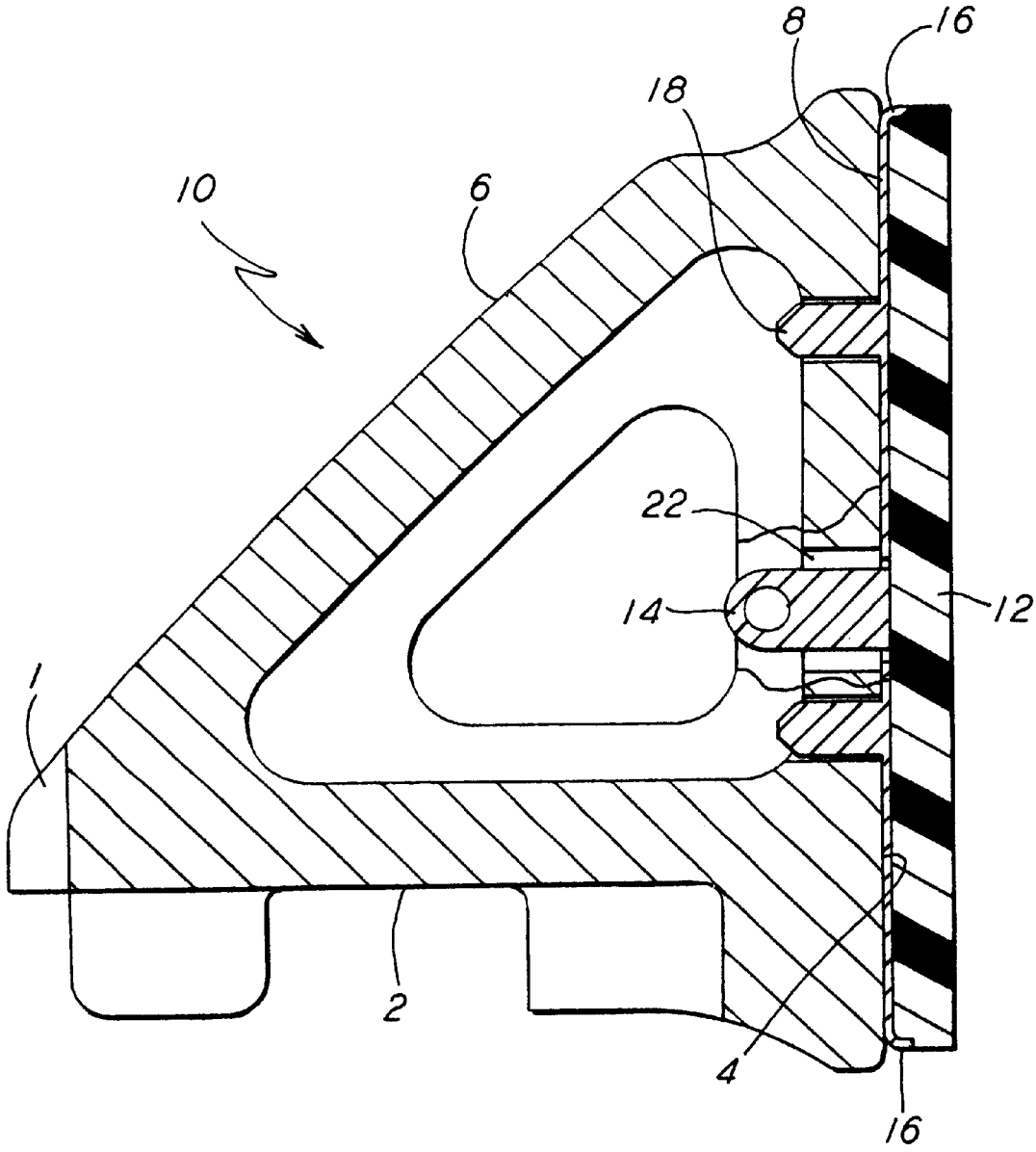
FIG. 1 is a sectional view of a friction wedge assembly with a composition wedge liner with a metal backing plate according to an embodiment of the invention.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Figure 2:
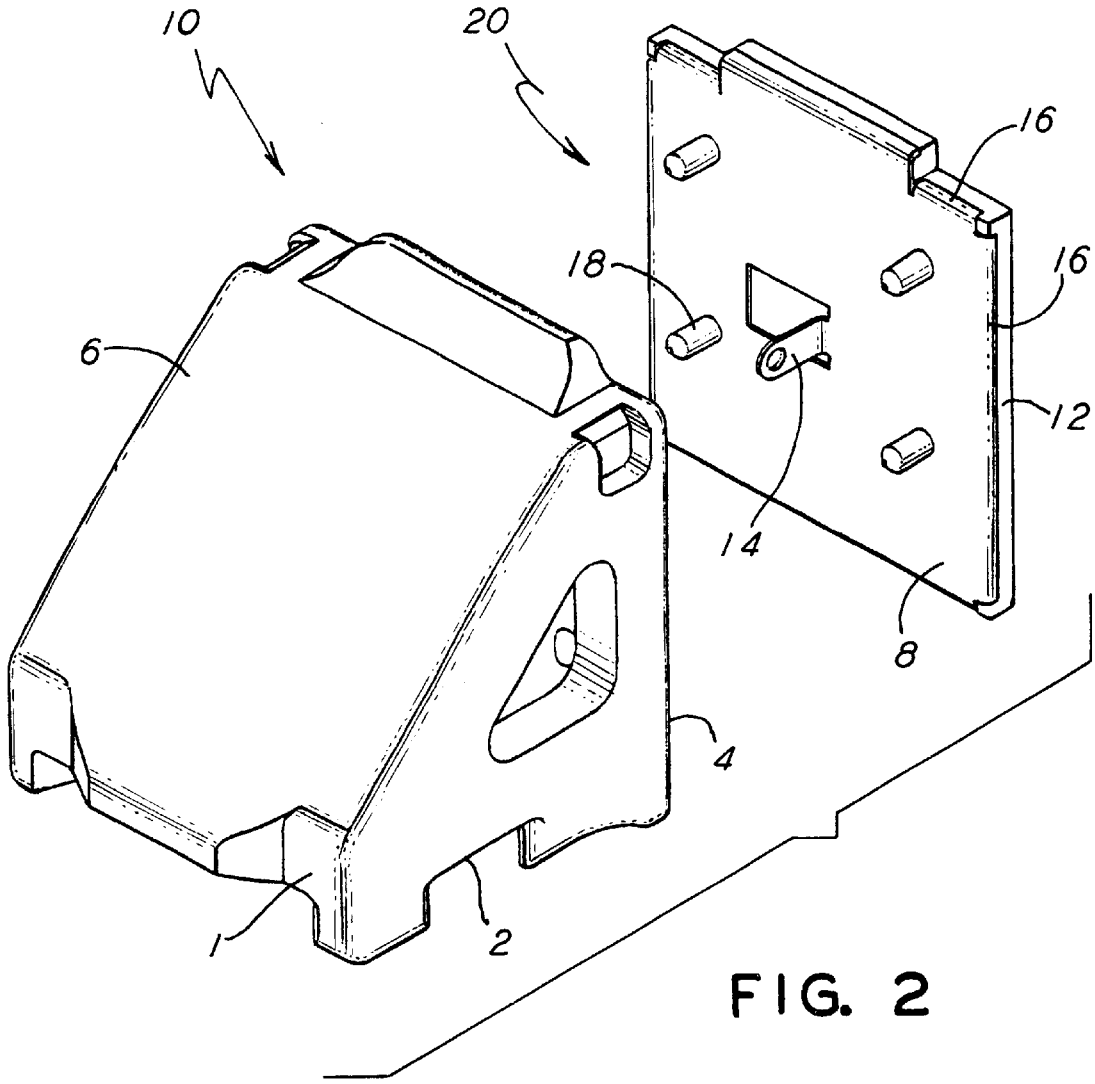
FIG. 2 is an exploded view of the friction wedge assembly with composition wedge liner with a metal backing plate according to an embodiment of the invention.

Illustrated in FIGS. 1 and 2 is a friction wedge assembly, generally designated 10, for use in a suspension system of railroad car trucks. Such friction wedge assembly 10 includes is a cast metal wedge 1 that has a bottom face 2, a vertical face 4 that is substantially perpendicular to the bottom face 2 and a sloped face 6. The sloped face 6 contacts a mating surface on a bolster of such railroad car truck (not shown). Although it is presently preferred that such wedge 1 be a metal casting it is within the scope of the invention that such wedge 1 be of other material.

The present invention provides a metal backing plate 8 that has a first side that is removably engageable with the vertical face 4 of the cast metal wedge 1. There is also a means, generally designated 20, for securing the metal backing plate 8 to the cast metal wedge 1. A composition liner 12 is disposed on a second side of such metal backing plate 8 for engaging such metal wear liner (not shown) on such side frame of such railroad car truck.

In a presently preferred embodiment of the invention such means 20 for securing the metal backing plate 8 to the cast metal wedge 1 includes a locking tab 14. Such locking tab 14 on the metal backing plate 8 is designed to protrude through a mating aperture 16 in the cast metal wedge 1. The locking tab 14 is secured to the cast metal wedge 1 by one of a cotter pin (not shown) which can be inserted in the opening in the locking tab 14 and by simply manually bending the locking tab 14. In a presently preferred embodiment of the invention such locking tab 14 is simply bent manually to hold the backing plate 8 and composition liner 12 in place on the cast metal wedge 1.

Thus, the use of the locking tab 14 permits for easy insertion but resists removal. This attachment feature, locking tab 14, need only hold the composition liner 12 and backing plate 8 in place on the cast metal wedge 1 until it is installed in the railroad car truck. Thereafter, the composition liner 12 is constrained between the cast metal wedge 1 and the metal wear liner on the railroad car truck frame. The composition liner 12, according to the present invention, can be replaced easily and thereby have a renewed wearing surface without the necessity of installing a completely new wedge casting or having the wedge casting sent out to have a new liner molded directly to it as is presently done. In an embodiment of the invention such locking tab 14 is formed integrally with the backing plate as a punching.

The backing plate 8, according to an embodiment of the invention, further includes a shallow lip 16 that is disposed substantially around the exterior of the backing plate 8 and is substantially perpendicular to the second side of the backing plate 8. Such shallow lip 16 partially encloses the composition liner 12 and keeps it in place even in the event of a loss of bond between the composition liner 12 and such metal backing plate 8. Additional features could be incorporated into the second side of the backing plate 8 that could create a mechanical interlock between the metal backing plate 8 and the composition liner 12. However, in a presently preferred embodiment of the invention such composition liner 12 is bonded to the second side of the metal backing plate 8.

The metal backing plate 8 also incorporates locating features on the first side which is the side that is engageable with the cast wedge assembly 1. The locating features include at least one locating pin 18 which mates with an aperture(s) on the vertical side 4 of the cast metal wedge 1 and permit the proper positioning of the metal backing plate 8 to the cast metal wedge 1. It is presently preferred that there are a plurality of locating pins 18 on the backing plate 8. It is further preferred that such plurality of locating pins 18 are four on such first side of such metal backing plate 8. It is also preferred that there be a plurality of matching apertures on the vertical side of the cast metal wedge 1. It is further preferred that this plurality be four mating apertures for the locating pins 18 on the vertical side 4 of the cast metal wedge 1.

These locating pins 18 serve both to accurately locate the composition liner 12 and backing plate 8 on the cast metal wedge 1 and to take the shear load between the cast metal wedge 1 and the backing plate 8 with the composition liner 12, keeping the assembly in place while in service. The shear strength of this arrangement is much higher than that found in prior art. To accept the new backing plate 8 and composition liner 12 the cast metal wedge 1 need only have suitable mating holes drilled into its vertical face. New castings can be produced with the holes cast in place, needing only a finish drilling to provide suitable tolerances for the locating pins 18. In this manner, existing cast metal wedges 1 can be modified at very low cost and new castings produced with only minor additional work. The present invention has the same overall dimensions as prior art liners; therefore, the operation of such complete friction wedge assembly 10 is identical to one utilizing prior art.

The present invention provides a composition liner 12 that is bonded to a metal backing plate 8 that mechanically connects to a modified cast metal wedge 1. This allows the use of a metal for the metal backing plate 8 which provides a superior bond to the composition material of the composition liner 12, compared to the bond with the cast metal that is used in the wedge. Also there are features included in the backing plate 8 which further improve the bond and hold the composition liner 12 in place even if the bond should fail. Such backing plate 8 and composition liner 12 can be replaced easily, when required, without the need of any special equipment or tools which should reduce maintenance costs.

While both the presently preferred and a number of alternative embodiments of the present invention have been described in detail above it should be understood that various other adaptations and modifications of the present invention can be envisioned by those persons who are skilled in the relevant art of railway braking systems without departing from either the spirit of the invention or the scope of the appended claims.

We claim:

1. A friction wedge assembly for use in a suspension system of railroad car trucks, said friction wedge assembly comprising:

(a) a wedge having a bottom face, a vertical face substantially perpendicular to said bottom face and a sloped face for contacting a mating surface on a bolster of such railroad car truck, said vertical face having a substantially planar surface and at least two apertures formed therethrough at predetermined locations;

(b) a metal backing plate having a substantially planar first side removably engageable with said substantially planar surface of said vertical face of said wedge;

(c) a first means disposed on said metal backing plate adjacent said first side thereof and engageable with said wedge through one of said at least two apertures for securing said metal backing plate to said wedge;

(d) a composition liner disposed on a second side of said metal backing plate for engaging a metal wear liner on a side frame of such railroad car truck;

(e) a second means disposed on said metal backing plate adjacent a first side thereof and engageable with a second one of said at least two apertures for proper positioning of said metal backing plate with said wedge; and wherein, the wedge does not include any portion that extends in the direction opposite to the facing direction of and beyond the planar first side of the backing plate as installed.

2. A friction wedge assembly, according to claim 1, wherein said wedge is a metal casting.

3. A friction wedge assembly, according to claim 2, wherein said first means for securing said metal backing plate to said cast metal wedge includes at least one locking tab.

4. A friction wedge assembly, according to claim 3, wherein said at least one locking tab on said metal backing plate is secured to said cast metal wedge by one of a cotter pin and bending of said at least one locking tab.

5. A friction wedge assembly, according to claim 4, wherein said at least one locking tab on said metal backing plate is secured to said cast metal wedge by bending said at least one locking tab.

6. A friction wedge assembly, according to claim 4, wherein said at least one locking tab is formed integrally with said backing plate as a punching.

7. A friction wedge assembly, according to claim 5, wherein said at least one locking tab is formed integrally with said backing plate as a punching.

8. A friction wedge assembly, according to claim 1, wherein said backing plate further includes a shallow lip disposed substantially around and substantially perpendicular to said second side.

9. A friction wedge assembly, according to claim 8, wherein said shallow lip partially encloses said composition liner.

10. A friction wedge assembly, according to claim 2, wherein said backing plate further includes a shallow lip disposed substantially around and substantially perpendicular to said second side.

11. A friction wedge assembly, according to claim 1, wherein said composition liner is bonded to said second side of said metal backing plate.

12. A friction wedge assembly, according to claim 2, wherein said second means disposed on said metal backing plate further includes at least one locating pin for proper positioning of said metal backing plate with said cast metal wedge.

13. A friction wedge assembly, according to claim 12, wherein said second means disposed on said metal backing plate includes a plurality of locating pins for proper positioning of said metal backing plate with said cast metal wedge.

14. A friction wedge assembly, according to claim 12, wherein said plurality of locating pins is four.

15. A friction wedge assembly, according to claim 13, wherein said cast metal wedge further includes a plurality of apertures for permitting said plurality of locating pins on said metal backing plate to protrude into said cast metal wedge.

16. A friction wedge assembly, according to claim 14, wherein said cast metal wedge further includes four apertures for permitting said four locating pins on said metal backing plate to protrude into said cast metal wedge.

17. A friction wedge assembly, according to claim 1, wherein said at least two apertures is five.

18. A friction wedge assembly, according to claim 2, wherein said composition liner is bonded to said second side of said metal backing plate.

19. A friction wedge assembly, according to claim 1, wherein said metal backing plate has an outer perimeter of a predetermined shape which extends outwardly from a substantially planar surface adjacent said first side thereof, said substantially planar surface adjacent said first side thereof being removably engageable with said vertical face of said wedge and said outer perimeter of said predetermined shape which extends outwardly from said substantially planar surface adjacent said first side being essentially a noncontact surface.

* * * * *